US007554491B2

(12) United States Patent
Burkholder et al.

(10) Patent No.: US 7,554,491 B2
(45) Date of Patent: Jun. 30, 2009

(54) LOW PROFILE DISTRIBUTED ANTENNA

(75) Inventors: Robert Burkholder, Columbus, OH (US); Walter D. Burnside, Dublin, OH (US)

(73) Assignee: Ohio State University Research Foundation, Columbus, OH (US)

( * ) Notice: Subject to any disclaimer, the term of this patent is extended or adjusted under 35 U.S.C. 154(b) by 0 days.

(21) Appl. No.: 11/690,562

(22) Filed: Mar. 23, 2007

(65) Prior Publication Data

US 2007/0273528 A1 Nov. 29, 2007

Related U.S. Application Data

(60) Provisional application No. 60/808,444, filed on May 25, 2006.

(51) Int. Cl.
*H01Q 1/38* (2006.01)

(52) U.S. Cl. ..... 343/700 MS; 343/770; 340/572.7

(58) Field of Classification Search ..... 343/767, 343/770, 700 MS; 340/572.7
See application file for complete search history.

(56) References Cited

U.S. PATENT DOCUMENTS

| | | | | |
|---|---|---|---|---|
| 5,726,666 | A * | 3/1998 | Hoover et al. | 343/770 |
| 5,757,329 | A * | 5/1998 | Hoover et al. | 343/770 |
| 6,480,163 | B1 * | 11/2002 | Knop et al. | 343/770 |
| 6,650,300 | B2 * | 11/2003 | Skalina et al. | 343/791 |
| 2001/0002117 | A1 * | 5/2001 | Schulze-Buxloh | 333/237 |
| 2007/0254587 | A1 * | 11/2007 | Schadler et al. | 455/13.3 |

* cited by examiner

*Primary Examiner*—HoangAnh T Le
(74) *Attorney, Agent, or Firm*—Standley Law Group LLP

(57) ABSTRACT

This invention provides low profile distributed antenna which comprises a first and second elongated continuous conductors being kept parallel to each other and forming a transmission line, a plurality of perturbation radiators on the first elongated continuous conductor, wherein a substantial amount of radio frequency energy transmitted by the transmission line radiates from the plurality of perturbation radiators, therefore, the transmission line serves as a low profile distributed antenna.

23 Claims, 3 Drawing Sheets

LOW PROFILE DISTRIBUTED ANTENNA

CROSS REFERENCE

The present application claims the benefits of U.S. Provisional Application Ser. No. 60/808,444, which was filed on May 25, 2006.

BACKGROUND

The present invention relates generally to radio energy transmission, and more specifically related to a distributed antenna for transporting radio energy through a defined medium.

The performance of indoor wireless communication systems, such as a radio frequency identification (RFID) system or wireless local area networks (WLANs), depends on the signal strength available at the receiving antenna, or more specifically, the signal-to-noise ratio (SNR) that the systems can obtain at the receiving end. Most systems use a single base station antenna that broadcasts enough power to sufficiently cover a given area. However, the signal strength may have a very significant variation, which is determined by the distance from the base station antenna to the receiver, signal attenuation caused by intervening structures between the base station and the receiver and the multi-path caused by scattering from nearby structures. Hence, the coverage is always limited, and an improvement is implemented to use higher transmitting power and/or multiple base stations to provide proper coverage for larger areas.

An example of a problematic indoor wireless environment is a room or enclosure that is long and narrow, such as a hallway, a long warehouse or factory, an aircraft cabin or a passenger car on a train. A single base station antenna in such an environment will not provide uniform coverage because the signal will be attenuated along the length of the enclosure. Therefore, multiple base stations or multiple antennas would need to be deployed in a distributed fashion in such a way that the coverage is uniform along the whole enclosure. Such a system would be complex, expensive, and invasive using existing technologies.

Another example of a communication system is the RFID system using RF transmission to identify, categorize, locate and track objects. The system is made up of two primary components: a transponder or the RFID tag and a reader. The tag is a device that generates electrical signals or pulses interpreted by the reader. The reader is a transmitter/receiver combination (transceiver) that activates and reads the identification signals from the transponder.

RFID tags are considered to be intelligent bar codes that can communicate with a networked system to track every object associated with a designated tag. RFID tags will communicate with an electronic reader that will detect the "tagged" object and further connects to a large network that will send information on the objects to interested parties such as retailers and product manufacturers. For example, the tag can be programmed to broadcast a specific stream of data denoting identity such as serial and model numbers, price, inventory code and date. Therefore, the RFID tags are expected to be widely used in the wholesale, distribution and retail businesses.

A reader also contains an RF antenna, transceiver and a micro-processor. The transceiver sends activation signals to and receives identification data from the tag. The antenna may be enclosed within the reader or located outside the reader as a separate piece. The reader may be either a hand-held or a stationary component that checks and decodes the data it receives.

It is of interest to communicate with RFID tags attached to merchandise (or containers) stored on shelves in a warehouse or retail establishment. With existing technology, this may be achieved in one of two ways: (1) a mobile RFID scanner that moves along the shelves, possibly hand-held, or (2) by mounting a large number of fixed scanners to cover all the shelves. The former approach is very time consuming and labor-intensive, while the latter approach is very complex and expensive. Furthermore, in the case of having multiple fixed scanners or base station antennas, it is difficult to conceal these devices in an aesthetically pleasing manner.

In view of the above applications, there is clearly a need to develop a system of improved wireless coverage without greatly increasing the level of complexity and cost for a wireless system such as the RFID system.

SUMMARY

This invention provides a low profile distributed antenna (LPDA) which comprises a first and second elongated continuous conductors being kept parallel to each other and forming a transmission line, a plurality of perturbations on the first elongated continuous conductor, wherein a substantial amount of radio frequency energy transmitted by the transmission line radiates from the plurality of perturbations, therefore, the transmission line serves as a low profile distributed antenna. The LPDA may be mounted along a wall, ceiling, or along shelves, and may have wide wireless applications.

The simplicity of this antenna system is that each radiator is fed in series; thus, one can have many radiators but only one feed point. In addition, the transmission line used to feed this structure is a very simple parallel-plate structure as opposed to more complex rectangular waveguides or coax cables. To illustrate this point, one can think of the parallel-plate structure as being made of a thin foam spacer that is used to separate two conductors, which can be conducting tape, conducting thin films, etc. Obviously, this type of parallel-plate structure is much simpler to build but it does not seem to be very precise or structurally sound. That is not the case in that the foam spacer can be manufactured today to very fine tolerances (a few thousands of an inch tolerance is achievable today in mass production). Also, this antenna can be encapsulated in a conduit that is used to precisely align the parallel-plate structure along its length and to protect it from a hostile outside environment. Since the conduit structure can be easily made using mass production techniques, this whole new antenna concept lends itself to precise, low cost, high volume antenna applications.

The construction and method of operation of the invention, however, together with additional objects and advantages thereof will be best understood from the following description of specific embodiments when read in connection with the accompanying drawings.

DESCRIPTION

The present invention provides an external radio energy propagation channel through the introduction of a low-profile linear distributed antenna (LPDA). The disclosed LPDA provides controlled radiation customized for each environment of interest. Further, it is a very cost-effective solution even though it is applied in terms of long lengths to provide the desired coverage within enclosed areas.

Figure 1:
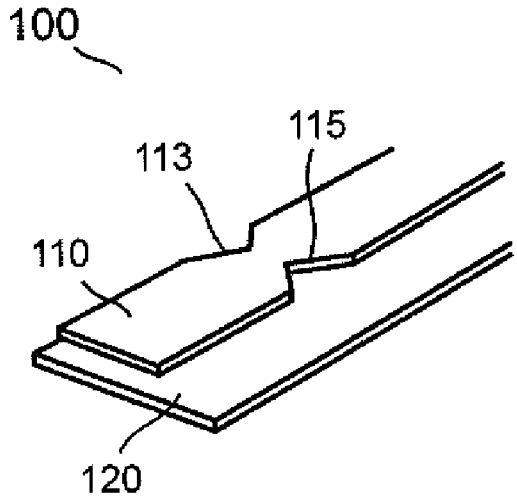
FIG. 1 is a perspective view of a V-shaped notch serving as a perturbation or radiator in a transmission line which functions as a low profile distributed antenna (LPDA) according to one embodiment of the present invention.

FIG. 1 is a perspective view of a V-shaped notch serving as a perturbation or radiator in a transmission line which functions as a low profile distributed antenna (LPDA) according to one embodiment of the present invention. The notched transmission line 100 comprises two thin-line parallel conductive plates 110 and 120 with bi-lateral V-shaped notches 113 and 115 cut at the top plate 110. As a result of the V-shaped notches 113 and 115, the notched transmission line 100 is "pinched" at the narrowed location, which causes radio energy to "leak out" or radiate. Therefore the notched transmission line 100 can serve as one example of a perturbation radiator. Although V-shaped notches 113 and 115 are used to create the perturbation, one having skills in the art would appreciate various other perturbation structures, either by cutting out notches of shapes other than the V-shape or by adding protruding objects on the transmission line, may be applied to turn the transmission line into a radiator.

Figure 2:
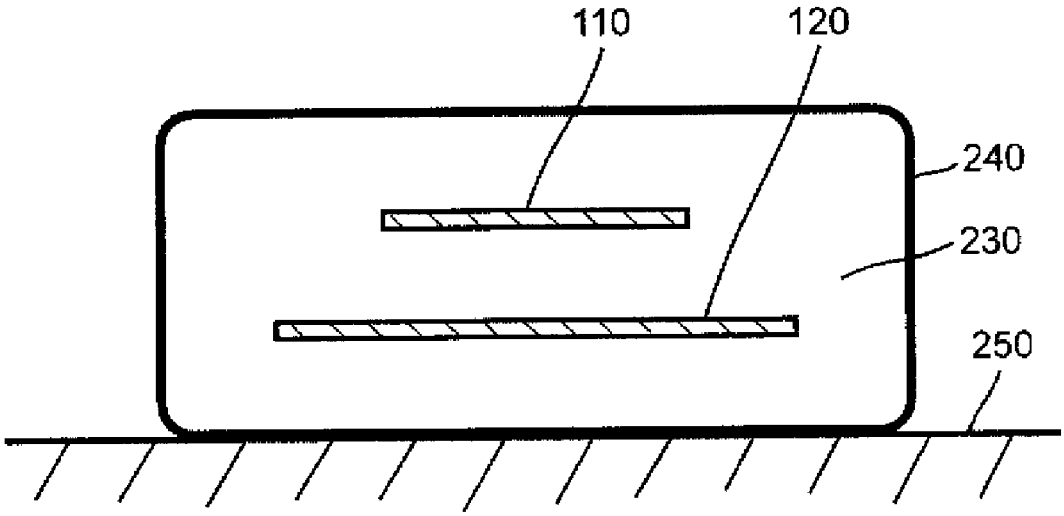
FIG. 2 is a cross-sectional view of the LPDA transmission line embedded in a foam conduit and encased in a plastic outer shell.

FIG. 2 is a cross-sectional view of the LPDA transmission line 100 embedded in a foam conduit 230 and encased in a predetermined outer shell 240 which can be made by various suitable materials such as plastic or rubber. The foam conduit 230 is a spacer and has very low-loss for RF energies. In a field application, the LPDA transmission line 100 may be placed on a mounting surface 250 on a bottom side closer to the bottom plate 120. Although the bottom plate 120 as shown in FIG. 2 is wider than the top plate 110 for practical purposes, one having skills in the art would recognize that a bottom plate can be the same or even smaller width than the top plate 110, though it may not perform as well. The V-shaped notches 113 and 115 shown in FIG. 1 are cut on the top plate 110. One having skills in the art may also recognize that the V-shaped notches 113 and 115 or any other perturbations may be added to either the top plate 110 or the bottom plate 120 or even on both plates 110 and 120. The shape, size and orientation of the perturbations may be used to control the radiation bandwidth, level, polarization, etc.

Referring to FIG. 2, the conduit is shown as a solid structure surrounding the LPDA transmission line 100. This conduit can also be designed in terms of two pieces that can be taken apart to adjust the radiators or to add splice sections as discussed later. To allow for easy access these two conduit pieces can be snapped together, for example. That being the case, one can change the LPDA antenna in the field. This may be very useful in complex application environments.

Figure 3:
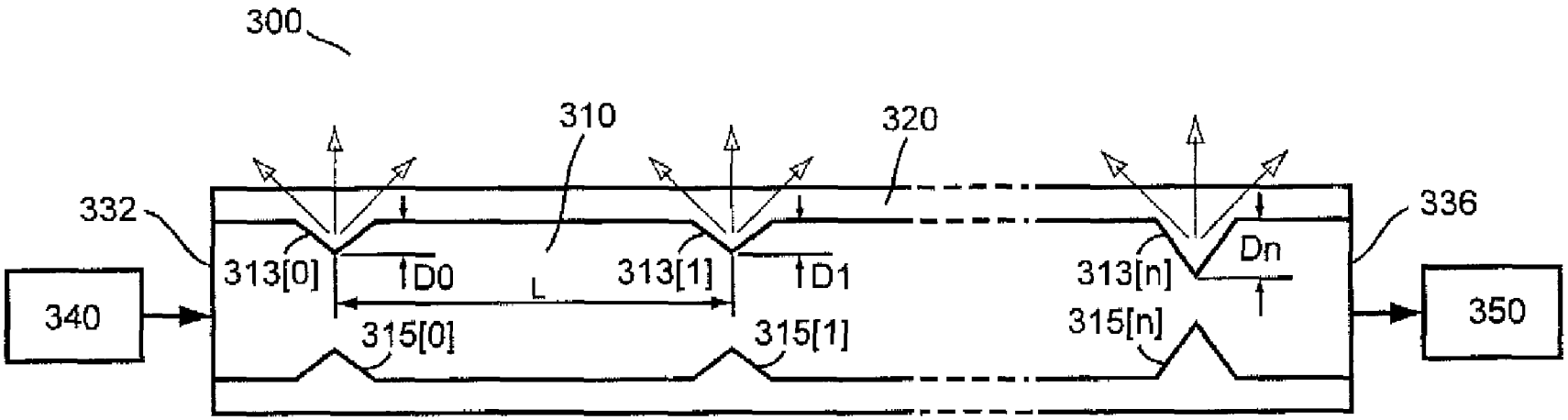
FIG. 3 is a top-view of the LPDA transmission line with the multiple perturbations represented by the V-shaped notches cut in its top plate.

FIG. 3 is a top-view of the LPDA transmission line 300 with multiple V-shaped notches 313[0:n] and 315[0:n] cut in its top plate 310 to serve as perturbation radiators. In this embodiment, a bottom plate 320 has no notch, and is wider than the top plate 310. The V-shaped notches 313[0:n] and 315[0:n] are cut symmetrically on both edges of the top plate 310, i.e., 313[0] and 315[0], 313[1] and 315[1], etc., are symmetrical. The V-shaped notches 313[0:n] and 315[0:n] may be cut at a regular interval L or at an irregular length across the length of the notched transmission line 300. The interval is determined by signal strengths of the radiations from the notches 313[0:n] and 315[0:n] to make sure that the areas in between the perturbation radiator locations are covered by the radiations therefrom. When radio frequency (RF) signal is fed at a left end 332 from a base station 340, the LPDA transmission line 300 will function as a low profile distributed antenna (LPDA) for the RF signal. To terminate the RF energy transmission at a right end 336, a termination 350 is connected thereto. This specific termination 350 is designed to provide better illumination of the enclosed environment.

Referring to FIG. 3, a depth of the notch, D0 for notch 313[0], D1 for notch 313[1] or Dn for notch 313[n], determines the amount of radiation from the notch. The deeper the notch is, the higher the radiation comes from the notch. At the same time the farther the RF signal propagates along the LPDA transmission line 300, the more it is attenuated. In order to keep the relative radiation from each notch uniform along the length of the transmission line 300, the depth of the notches 313[0:n] and 315[0:n] varies from small to large from the feed end 332 to the termination end 336. For example, D1 is designed to be larger than D0, and Dn is the largest among all the notches as it is at the right end 336 of the notched transmission line 300. It is this controlled radiation that provides a uniform coverage for the wireless system. Also by controlling the width of the notches one can also ensure that very little energy is lost due to reflections back into the feed or absorption at the termination.

As the LPDA transmission line 300 may be constructed by other perturbation structures, one having skills in the art would employ different mechanisms for controlling the radiations that are appropriate for the respective perturbation structures, yet still produce similar uniform radiation patterns as described above, or a prescribed radiation pattern for a specific application.

In an alternative embodiment, the notched transmission line 300 may be divided into multiple sections of various lengths. Notches within a section may have the same or different depths, while notches in sections farther away from the feed end 332 become deeper as the distances grow. This allows the radiation to become more uniform along the full length of the LPDA.

Although, as shown in FIG. 3, the perturbations or notches, 313[0:n] on one edge and 315[0:n] on the other of the top plate 310, are symmetrical, one having skills in the art would realize that the perturbations can be unsymmetrical or even just on one edge to emphasize radiation on that edge of the LPDA transmission line 300.

Figure 4:
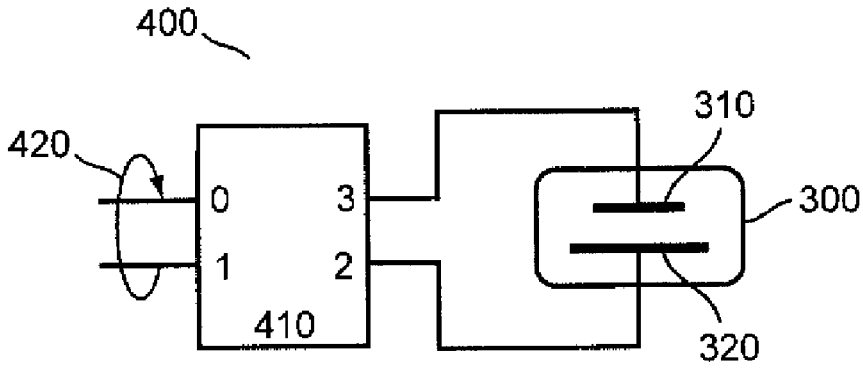
FIG. 4 is schematic diagram illustrating a feed circuit for the LPDA.

FIG. 4 is schematic diagram illustrating a feed circuit 400 specially designed for the LPDA formed by the LPDA transmission line 300 as shown in FIG. 3. The feed circuit 400 matches the parallel plates 310 and 320 of the notched transmission line 300 to a standard coaxial cable 420 from a RF signal transmitter (not shown), so that reflections back into the transmitter are minimized. In one case, the feed circuit 400 comprises a 180 degree hybrid 410 with input difference terminal 0 connected to the coax cable 420. A 0 degree hybrid output 2 is connected to the top plate 310 or bottom plate 320 of the LPDA transmission line 300, while a 180 degree output 3 is connected to the other plate. The feed circuit 400 may also be used for the termination of the LPDA transmission line 300 in the matched load 350 as shown in FIG. 3. The feed can also be done by using a standard cable connection in which the outer conductor is connected to one of the plates and the coaxial center conductor to the other plate.

In addition, one wants to match the impedance of the LPDA transmission line with the feed impedance. This may be done having the LPDA parallel-plate spacing transition from its normal dimension to one that provides the desired impedance. At the same time, the conductor widths can be changed if needed to provide the desired impedance level to match that of the feed network as described previously.

With the parallel plate structure, two pieces of the transmission line 300 can be easily joined together or even spliced in the field when greater length of coverage by the LPDA is needed.

Figure 5A:
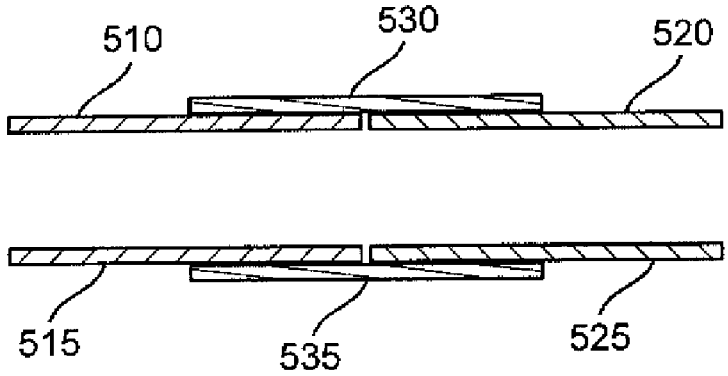
FIGS. 5A and 5B are cross-sectional views of splicing structures for joining two LPDA transmission lines.
Figure 5B:
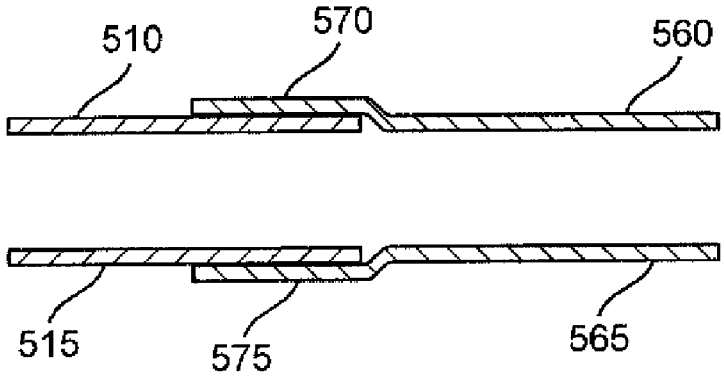

FIGS. 5A and 5B are cross-sectional views of splicing structures for joining two LPDA transmission lines. The cross-sections are made along lengths of the LPDA transmission lines. Referring to FIG. 5A, a left-hand-side transmission line has a top plate 510 and a bottom plate 515. A right-hand-side transmission line of the same dimension as the left-hand-side transmission line has a top plate 520 and a bottom plate 525. In order to join the left-hand-side and right-hand-side transmission lines, a splice conductor having a top plate 530 and a bottom plate 535 is used. One can think of the LPDA transmission lines being mounted in the conduit 230 as shown in FIG. 2. The conduit 230 is made in two parts that separate and can be snapped, bonded or held together. That being the case, the splice piece 535 can be placed in the bottom section of the conduit 230. The two LPDA transmission lines are laid on top of this splice piece 535. After that the top splice piece 530 is added and the top of the conduit 230 is used to hold everything together. With continued reference to FIG. 5A, one can see that a connection between the top plates 510 and 520 is made through the top plates 530, and a connection between the bottom plates 515 and 525 is made through the bottom plate 535.

Referring to FIG. 5B, the left-hand-side transmission line remains the same as shown in FIG. 5A, however, the right-hand-side transmission line has a wider space between a top end-plate 570 and a bottom end-plate 575. The rest of the top plate 560 and bottom plate 565 of the right-hand-side transmission line have the same spacing as the top and bottom plates 510 and 515 of the left-hand-side transmission line. The wider space between a top end-plate 570 and a bottom end-plate 575 just allows the top and bottom plates 510 and 515 to slide in and maintain tight contacts between the top end-plate 570 and the top plate 510 and between the bottom end plate 575 and the bottom plate 515. In such a way, the left-hand-side transmission line and the right-hand-side transmission line are spliced. However, splice connectors for joining the left-hand-side and the right-hand-side transmission lines need to be carefully designed to minimize reflections from the junctions. Note that the conduit structure can be used to hold the LPDA transmission in alignment even though the LPDA transmission line itself can be rather flimsy.

Designing of the LPDA can be assisted by electromagnetic (EM) modeling software to determine the radiator size, shape, orientation, etc. A properly designed LPDA may be used to cover indoor wireless bands from 800 MHz up to 6 GHz and even beyond.

Although the present disclosure uses notches to illustrate the inventive LPDA structure, one having skills in the art would appreciate that the essence of the present invention lies in the fact that one can use any perturbation along the length of this parallel-plate transmission line to cause radiation. The size, shape and orientation of these radiators can be used to control the radiation bandwidth, radiation level, radiated polarization, etc. Therefore, other kinds of radiators may also be used to form the LPDA, as long as at least one conductor of the transmission line has a plurality of radiators from each of them a substantial amount of transmitted RF energy can be radiated from the transmission line.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A distributed antenna comprising:

first and second elongated continuous parallel-plate conductors forming a transmission line such that the first and second conductors are electrically unconnected;

a first perturbation radiator on the first elongated continuous conductor; and a second perturbation radiator also on the first elongated conductor but at a location different from the first perturbation radiator, wherein a substantial amount of radio frequency (RF) energy adapted to be transmitted by the transmission line is adapted to radiate from the first and second perturbation radiators, therefore, the transmission line is adapted to serve as a distributed antenna.

2. The distributed antenna of claim 1, wherein a plurality of perturbation radiators exist at a plurality of locations on the first elongated conductor, wherein a substantial amount of RF energy transmitted by the transmission line radiates from each of the perturbation radiators, therefore, the transmission line serves as a distributed antenna.

3. The distributed antenna of claim 2, wherein the spacings between every two of the perturbation radiators and/or the physical dimensions of each perturbation radiator are defined in such a way as to produce a predetermined pattern of radiated RF energy from the distributed antenna.

4. The distributed antenna from claim 1, wherein the second perturbation radiator is designed to radiate more RF energy than the first perturbation radiator when a signal transmitting device is coupled to an end of the transmission line closer to the first than the second perturbation radiator.

5. The distributed antenna of claim 1, further comprising a 180 degree hybrid with inputs coupled to a signal transmitter and 0 degree and 180 degree outputs coupled to the first and second continuous elongated conductors, respectively.

6. A distributed antenna comprising:

first and second elongated continuous conductors being parallel to each other and forming a transmission line;

at least cone conduit surrounding the first and second elongated continuous conductors, the conduit having low radio frequency energy loss;

at least one shell encasing the one or more conduits;

a first perturbation radiator on the first elongated continuous conductor; and a second perturbation radiator also on the first elongated conductor but at a location different from the first perturbation radiator, wherein a substantial amount of radio frequency (RF) energy adapted to be transmitted by the transmission line is adapted to radiate from the first and second perturbation radiators, therefore, the transmission line is adapted to serve as a distributed antenna.

7. The distributed antenna if claim 6, wherein a plurality of perturbation radiators exist at a plurality of locations on the first elongated conductor, wherein a substantial amount of RF energy transmitted by the transmission line radiates from each of the perturbation radiators, therefore, the transmission line serves as a distributed antenna.

8. The distributed antenna of claim 7, wherein the spacings between every two of the perturbation radiators and/or the physical dimensions of each perturbation radiator are defined in such a way as to produce a predetermined pattern of radiated RF energy from the distributed antenna.

9. The distributed antenna of claim 6, wherein both the first and second elongated continuous conductors are parallel plates.

10. The distributed antenna of claim 9, wherein a width of the first elongated continuous conductor is smaller than a width of the second elongated continuous conductor, and wherein the second elongated continuous conductor us closer to a mounting surface of the transmission line than the first elongated continuous conductor.

11. The distributed antenna of claim 9, wherein each of the first and second perturbation radiators is formed by a pair of symmetrical notches cut on opposite edges of the first elongated continuous conductive plate.

12. The distributed antenna of claim 6, wherein the second perturbation radiator is designed to radiate more RF energy than the first perturbation radiator when a signal transmitting device is coupled to an end of the transmission line closer to the first than the second perturbation radiator.

13. The distributed antenna of claim 6, wherein the at least one conduit is made of a predetermined foam material.

14. The distributed antenna of claim 6 further comprising a 180 degree hybrid with inputs coupled to a signal transmitter and 0 degree and 180 degree outputs coupled to the first and second continuous elongated conductors, respectively.

15. A distributed antenna comprising:

first and second elongated continuous conductive plates being parallel to each other and forming a transmission line;

a first notch cut on a first edge of the first elongated continuous conductive plate; and a second notch cut on a second edge of the second elongated conductive plate, wherein a substantial amount of radio frequency energy adapted to be transmitted by the transmission line is adapted to radiate from the first and second notches, therefore, the transmission line is adapted to serve as a distributed antenna.

16. The distributed antenna of claim 15, wherein a width of the first elongated continuous conductive plate is smaller than a width of the second elongated continuous conductive plate, and wherein the second elongated continuous conductive plate is closer to a mounting surface of the transmission line than the first elongated continuous conductive plate.

17. The distributed antenna of claim 15, wherein the second notch has deeper cut than the first notch when a signal transmitting device is coupled to an end of the transmission line closer to the first notch than the second notch.

18. The distributed antenna of claim 15 further comprising:

one or more conduits surrounding the first and second elongated continuous conductive plates, the conduits having low radio frequency energy loss, and one or more shells encasing the one or more conduits.

19. The distributed antenna of claim 15 further comprising a 180 degree hybrid with inputs coupled to a signal transmitter and 0 degree and 180 degree outputs coupled to the first and second continuous elongated conductive plates, respectively.

20. A distributed antenna comprising:

first and second elongated continuous conductors being parallel to each other and forming a transmission line;

a first perturbation radiator on the first elongated continuous conductor; and a second perturbation radiator also on the first elongated conductor but at a location different from the first perturbation radiator, wherein both the first and second elongated continuous conductors are parallel plates, a substantial amount of radio frequency (RF) energy adapted to be transmitted by the transmission line is adapted to radiate from the first and second perturbation radiators, therefore, the transmission line is adapted to serve as a distributed antenna, a width of the first elongated continuous conductor is smaller than a width of the second elongated continuous conductor, and wherein the second elongated continuous conductor is closer to a mounting surface of the transmission line than the first elongated continuous conductor.

21. A distributed antenna comprising:

first and second elongated continuous conductors being parallel to each other and forming a transmission line;

a first perturbation radiator on the first elongated continuous conductor; and a second perturbation radiator also on the first elongated conductor but at a location different from the first perturbation radiator, wherein both the first and second elongated continuous conductors are parallel plates, a substantial amount of radio frequency (RF) energy adapted to be transmitted by the transmission line is adapted to radiate from the first and second perturbation radiators, therefore, the transmission line is adapted to serve as a distributed antenna, and each of the first and second perturbation radiators is formed by a pair of symmetrical notches cut on opposite edges of the first elongated continuous conductive plate.

22. A distributed antenna comprising:

first and second elongated continuous conductors being parallel to each other and forming a transmission line;

a first perturbation radiator on the first elongated continuous conductor;

a second perturbation radiator also on the first elongated conductor but at a location different from the first perturbation radiator;

at least one conduit surrounding the first and second elongated continuous conductors, the conduit adapted to have low radio frequency energy loss; and at least one shell encasing the at least one conduit, wherein a substantial amount of radio frequency (RF) energy adapted to be transmitted by the transmission line is adapted to radiate from the first and second perturbation radiators, therefore, the transmission line is adapted to serve as a distributed antenna.

23. The distributed antenna of claim 22, wherein the at least one conduit is made of a predetermined foam material.

* * * * *

UNITED STATES PATENT AND TRADEMARK OFFICE

CERTIFICATE OF CORRECTION

PATENT NO. : 7,554,491 B2
APPLICATION NO. : 11/690562
DATED : June 30, 2009
INVENTOR(S) : Burkholder et al.

It is certified that error appears in the above-identified patent and that said Letters Patent is hereby corrected as shown below:

In column 6, line 58, please delete "cone" and insert -- one --.

In column 7, line 21, please delete "us" and insert -- is --.

Signed and Sealed this

Eleventh Day of August, 2009

David J. Kappos

David J. Kappos
*Director of the United States Patent and Trademark Office*